United States Patent [19]

Daar et al.

[11] Patent Number: 4,524,772

[45] Date of Patent: Jun. 25, 1985

[54] APPARATUS FOR HAIR REMOVAL

[76] Inventors: Yair Daar, Moshav Galia; Shimon Yahav, 11 Moshe Mizrachi St., Rehovot, both of Israel

[21] Appl. No.: 516,699

[22] Filed: Jul. 22, 1983

[30] Foreign Application Priority Data

Aug. 20, 1982 [IL] Israel ..... 66595
Jun. 15, 1983 [IL] Israel ..... 68990

[51] Int. Cl.[3] ..... A61B 17/00
[52] U.S. Cl. ..... 128/355; 17/47
[58] Field of Search ..... 128/355; 17/47

[56] References Cited

U.S. PATENT DOCUMENTS

| | | | |
|---|---|---|---|
| 1,232,617 | 7/1917 | Shipp | 128/355 |
| 1,743,590 | 1/1930 | Binz . | |
| 2,458,911 | 1/1949 | Kerr | 128/354 |
| 2,486,616 | 1/1949 | Schubiger | 128/354 |
| 2,900,661 | 8/1959 | Schnell | 17/11.1 |
| 4,079,741 | 3/1978 | Daar et al. | 128/355 |

FOREIGN PATENT DOCUMENTS

| | | | |
|---|---|---|---|
| 179261 | 12/1935 | Switzerland | 128/355 |
| 268696 | 9/1950 | Switzerland . | |
| 203970 | 9/1923 | United Kingdom | 128/355 |

*Primary Examiner*—Stephen C. Pellegrino
*Assistant Examiner*—Gene B. Kartchner
*Attorney, Agent, or Firm*—Brumbaugh, Graves, Donohue & Raymond

[57] ABSTRACT

An electrically powered depilatory device including a hand held portable housing, motor apparatus disposed in the housing, and a helical spring comprising a plurality of adjacent windings arranged to be driven by the motor apparatus in rotational sliding motion relative to skin bearing hair to be removed, the helical spring including an arcuate hair engaging portion arranged to define a convex side whereat the windings are spread apart, and a concave side corresponding thereto whereat the windings are pressed together, the rotational motion of the helical spring producing continuous motion of the windings from a spread apart orientation at the convex side to a pressed together orientation at the concave side and for engagement and plucking of hair from the skin, whereby the surface velocities of the windings relative to the hair greatly exceeds the surface velocity of the housing relative thereto.

30 Claims, 14 Drawing Figures

APPARATUS FOR HAIR REMOVAL

FIELD OF THE INVENTION

The present invention relates to an electrically powered depilatory device, useful for cosmetic applications.

BACKGROUND OF THE INVENTION

Body hair at undesirable locations on the human body has been a source of embarrassment and concern to women throughout the ages. Cream depilatory agents are widely used despite their unpleasantness of their use, and the skin irritation that they often produce. Melted wax is also applied to the skin for this purpose.

There are known both manually operated and power driven mechanical depilatory devices. One type of manually operated device, exemplified in U.S. Pat. Nos. 2,458,911; 2,486,616 and 1,743,590 and Swiss Pat. No. 268,696, employs a coil spring which engages hairs in spaces between the convolutions thereof and pulls the hair away from the skin as the spaces between the convolutions are closed. The operation of this type of device may be characterized in that it is highly inefficient, slow and painful.

Power driven depilatory devices are exemplified in U.S. Pat. No. 2,900,661 and U.S. Pat. No. 4,079,741 of applicants herein. U.S. Pat. No. 2,900,661 describes a rotary drum having a wedge-like configuration for engagement with and removal of feathers, hairs and the like from poultry. U.S. Pat. No. 4,079,741 describes a hair plucking device employing an axially disposed helical spring which is simultaneously driven in axial rotation by an electric motor and reciprocatingly compressed and extended by a cam operated by the electric motor. This apparatus is relatively complex and costly and is not suited for home use.

In summary, the prior art mechanical depilatory apparatus does not include apparatus suitable for home use which provides efficient cosmetic hair removal. Simply stated, the analog to a man's electric razor for female hair removal at the root is not available. The widespread need for such appliance may be readily appreciated by considering the widespread advertising and sales of cream depilatories notwithstanding their acknowledged drawbacks.

SUMMARY OF THE INVENTION

The present invention seeks to provide to the marketplace an electrically driven mechanical depilatory appliance which provides efficient hair removal by a device, whose size, complexity, cost and convenience compare favorably with an electric razor.

There is thus provided in accordance with an embodiment of the present invention an electrically powered depilatory device including a hand held portable housing, motor apparatus disposed in the housing, and a helical spring comprising a plurality of adjacent windings arranged to be driven by the motor apparatus in rotational sliding motion relative to skin bearing hair to be removed, the helical spring including an arcuate hair engaging portion arranged to define a convex side whereat the windings are spread apart, and a concave side corresponding thereto whereat the windings are pressed together, the rotational motion of the helical spring producing continuous motion of the windings from a spread apart orientation at the convex side to a pressed together orientation at the concave side and for engagement and plucking of hair from the skin, whereby the surface velocities of the windings relative to the hair greatly exceeds the surface velocity of the housing relative thereto.

Further in accordance with an embodiment of the invention, the helical spring arcuate hair engaging portion extends along an arc subtending more than 90 degrees and preferably more than 180 degrees, whereby the surface velocities of windings of the helical spring simultaneously include components extending in mutually perpendicular directions, for significantly enhanced hair removal efficiency.

Additionally in accordance with an embodiment of the present invention there is provided an electrically powered depilatory device including a hand held portable housing, motor apparatus disposed in the housing, and a helical spring comprising a plurality of adjacent windings arranged in a loop for being driven in rotational motion by the motor apparatus, the helical spring loop defining along substantially the entire length thereof an arcuate hair engaging portion arranged to define a convex side whereat the windings are spread apart, and a concave side corresponding thereto whereat the windings are pressed together, the rotational motion of the helical spring producing continuous motion of the windings from a spread apart orientation at the convex side to a pressed together orientation at the concave side and for engagement and plucking of hair from the skin of the subject.

Further in accordance with an embodiment of the invention, the helical spring is oriented such that at the convex side of the hair engaging portion, the orientation of adjacent spread apart windings defines an angle therebetween of at least 1.5 degrees and preferably at least 2 degrees.

Additionally in accordance with an embodiment of the invention the helical spring is oriented such that at the convex side of the hair engaging portion, the orientation of the adjacent spread apart windings defines a maximum separation of at least 0.15 mm and preferably at least 0.2 mm.

Additionally in accordance with an embodiment of the invention, the helical spring is driven in rotary motion having a surface velocity of at least about 70 meters per minute and preferably in the range of between 100 and 200 meters per minute.

Further in accordance with an embodiment of the invention, the housing is defined as a modular two part housing, one part including the motor apparatus and the other part including the helical spring. The part including the helical spring may be readily removed from the part including the motor apparatus for easy sanitization of the helical spring or replacement thereof as necessary.

It is noted that although the motor apparatus is preferably electrically powered, alternatively powered motor apparatus such as pneumatically or hydraulically powered motor apparatus may alternatively be employed. The motor apparatus typically comprises a pair of motors coupled to respective opposite free ends of the helical spring. Alternatively a single motor may be employed.

BRIEF DESCRIPTION OF THE DRAWINGS

The present invention will be understood and appreciated more fully from the following detailed description taken in conjunction with the drawings in which.

DETAILED DESCRIPTION OF THE INVENTION

Figure 1:
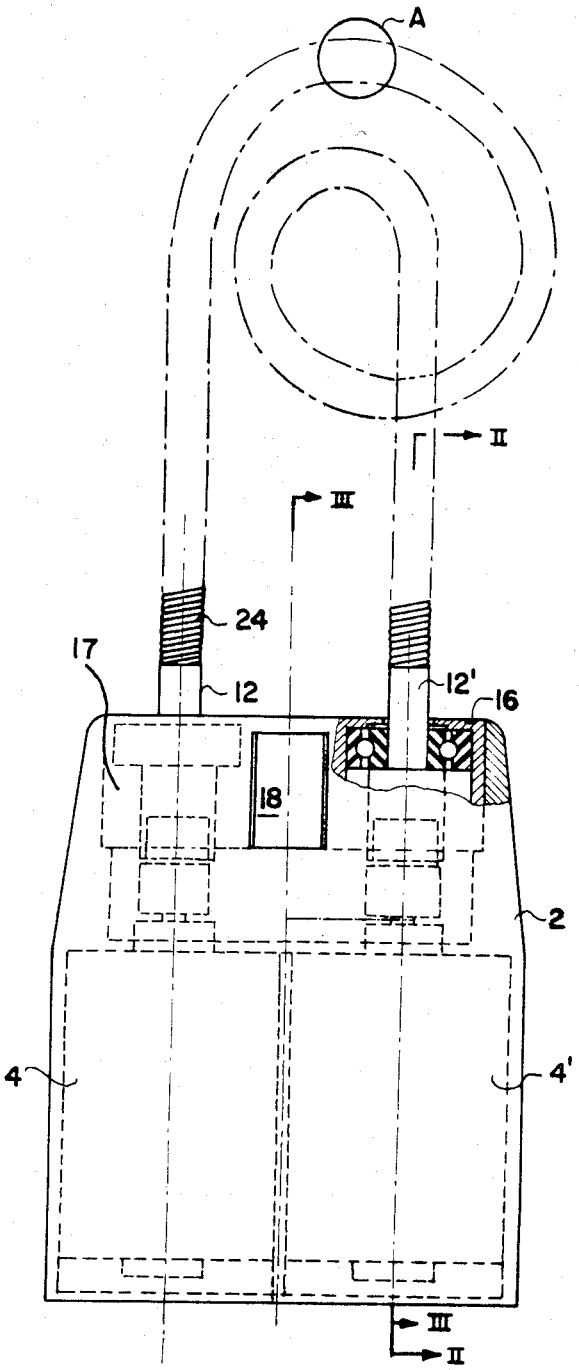
FIGS. 1 and 2 are respective front and side view, partially cut away, slightly enlarged illustrations of depilatory apparatus constructed and operative in accordance with a preferred embodiment of the present invention, FIG. 2 being taken in the plane II—II indicated in FIG. 1.
Figure 2:
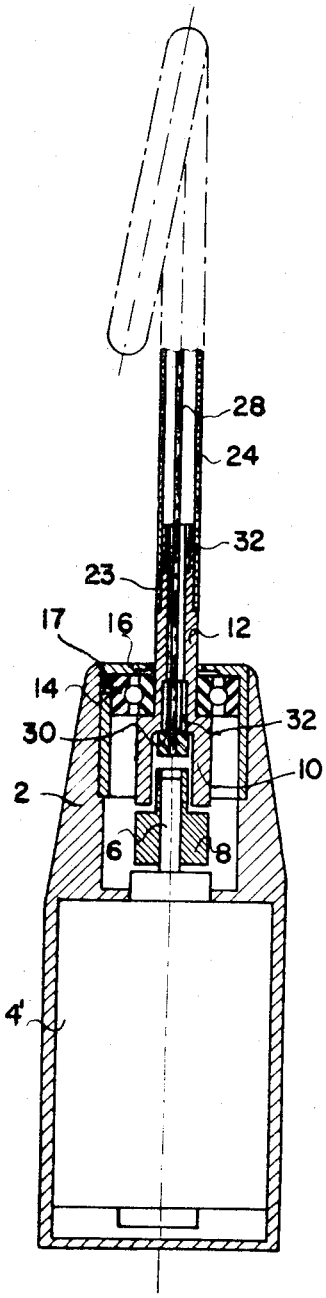
Figure 3:
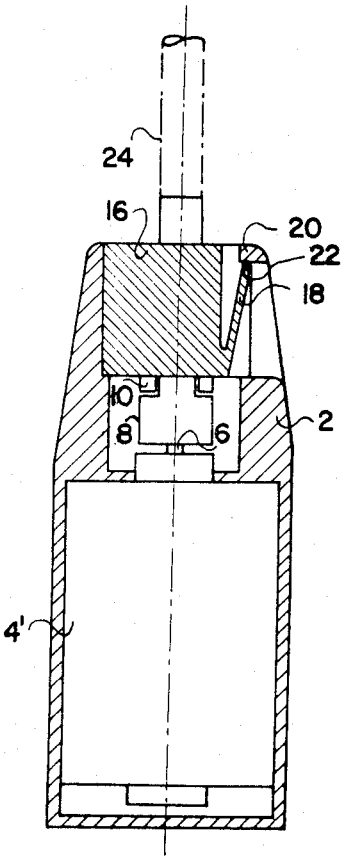
FIG. 3 is a sectional side view illustration of the apparatus of FIGS. 1 and 2 taken in the plane III—III, illustrated in FIG. 1.

Referring now to the drawings, and particularly to FIGS. 1–3, there is seen a housing 2 of a size comfortably held in one hand. Disposed in the lower part of the interior of the housing 2 there are provided two electric motors 4 and 4′ which are wired in opposite senses. The shafts 6 of the electric motors typically carry the tongue members 8 of simple tongue and groove type couplings, the groove member 10 of which is, in this embodiment, an integral part of first and second spindles 12 and 12′ rotatably mounted in ball bearings 14 seated in a bearing mount 16 insertable into an appropriately shaped recess 17 in the upper part of the housing 2.

In this context, the term "spindle" is to be understood in its widest meaning, including any means usable to connect an end of the helical spring to a rotary bearing and/or to a source or intermediary of rotary power. Alternatively, the helical spring may be directly mounted without any intermediary onto the shafts 6 of the electric motors 4 and 4′. As a further alternative, the rotary power may be imparted from one or more electric motors to the helical spring by engagement with one or more annular locations along the spring surface, not necessarily at the extreme ends of the spring.

Since for a purpose to be explained hereinbelow, the bearing mount 16 should be interchangeable, it is constructed to define a sliding bayonet type removable engagement with the housing at the upper housing recess 17. When the bearing mount is fully seated in recess 17, an elastic tongue 18, integral therewith, snaps below a catch 20 which is defined by housing 2. Removal of the bearing mount 16 from recess 17 is effected by pressing the elastic tongue 18, until the tip 22 thereof is flexed beyond the reach of catch 20, after which the bearing mount 16 can be pulled out.

Figure 4:
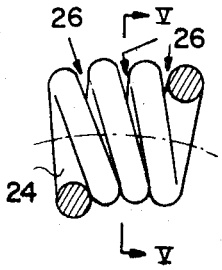
FIG. 4 is an enlarged representation of a portion of the helical spring employed in the apparatus of FIG. 1 and there indicated by reference letter A.

Spindles 12 and 12′ are provided with slightly narrowed ends 23, onto which are fixedly attached the ends of a compact, closely wound helical spring 24, a preferred configuration of which is illustrated in FIG. 1. An enlarged section of the curved portion marked A in FIG. 1 is shown in FIG. 4, where it is clearly seen that curvature of the spring 24 has the effect of spreading the windings on the convex side of the arcuate portion, while on the concave side of this portion, the windings are even more pressed together, thus forming wedge-like gaps 26 which, as will be explained below, are instrumental in the depilatory action of the device.

In accordance with a preferred embodiment of the invention, the helical spring is oriented such that at the convex side of the hair engaging portion, the orientation of adjacent spread apart windings defines an angle therebetween of at least 1.5 degrees and preferably at least 2 degrees.

Further in accordance with a preferred embodiment of the invention, the helical spring is oriented such that at the convex side of the hair engaging portion, the orientation of the adjacent spread apart windings defines a maximum separation of at least 0.15 mm and preferably at least 0.2 mm.

In order to impart some stiffness to the spring 24 so as to enable it, as will be shown below, to be applied against the skin of the user, a stiffening wire 28, seen in FIG. 2, is introduced into the spring 24. The wire, preferably formed of steel and alternatively of any suitable material, is anchored on both of its ends by means of terminal elements 30 located inside the groove member 10. The stiffening wire 28 need not participate in the rotation of the spring 24. In order to reduce friction between the rotating spindles 12, 12′ and the length of wire 28 located inside these spindles, bushings 32, made of a low-friction material such as bronze or teflon, are usually provided.

Figure 5:
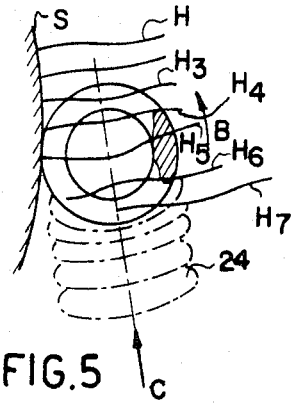
FIG. 5 is a cross sectional schematic representation of the spring portion of FIG. 4 taken in the plane V—V illustrated in FIG. 4.

The operation of the device illustrated in FIGS. 1–4 may be understood from a consideration of these drawings together with FIG. 5. FIG. 5 illustrates a portion of skin S having thereon unwanted hair H, which it is sought to remove. In the illustrated embodiment, the motor 4 is preferably wired for rotation in a clockwise sense, and the motor 4′ is wired for rotation in a counterclockwise sense, thereby to cause the operative regions of the spring 24 in FIG. 5 to rotate as indicated by arrow B. As the housing 2 device advances in the direction indicated by arrow C, hair H 3 is just entering a gap 26, seen in FIG. 4, while hair H 4 is already well inside the gap. Hair H 5 is about to be wedged between two adjacent windings, hair H 6 has just been plucked and hair H 7 is being ejected by the rotating spring.

It is a particular feature of the present invention that the surfaces of the windings of spring 24 move in sliding motion relative to the hair to be plucked, rather than in rolling motion. Due to this type of motion, substantially all of the hair in an engaged region is plucked. It is a further feature of the present invention that the speed of surface rotation of the windings greatly exceeds the speed of movement of the entire housing over the skin. It is noted that the apparatus of the present invention need not and should not be forced against the skin to operate properly.

While the spring configuration shown in FIG. 1 has been found to be suitable for most purposes, the above-described exchangeability of the bearing mount 16 and associated spring 24 enables the use of a variety of other spring configurations to particularly suit specific portions of the body. Such configurations are shown schematically in FIGS. 9–14, each of which is, of course, supplied with its own bearing mount. This modular separability also enables sanitization of the spring 24 and associated body contacting assembly separately from the motor housing and enables the spring 24 to be cleaned using techniques to which the motor housing could not be subjected.

The looping spring configuration of the present invention is a particular feature thereof in that there are simultaneously present at all times windings of the helical spring whose component of velocity relative to the hair extends in mutually perpendicular directions. The apparatus thus is operative to remove hair oriented in various directions without requiring movement of the housing against the skin in all of these directions.

The actual plucking of the hair takes place rapidly, the spring windings, having surface speeds in the range of between about 100 and 150 meters/minute. Therefore, the amount of pain experienced by the user is minimized.

Figure 8:
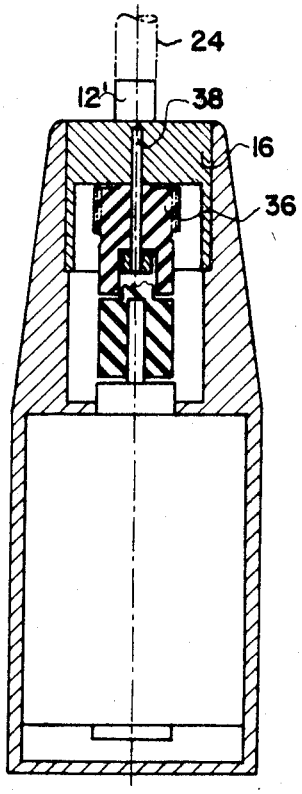
FIG. 8 is a side view sectional illustration of the apparatus of FIG. 6 taken in the plane VIII—VIII illustrated in FIG. 6.
Figure 6:
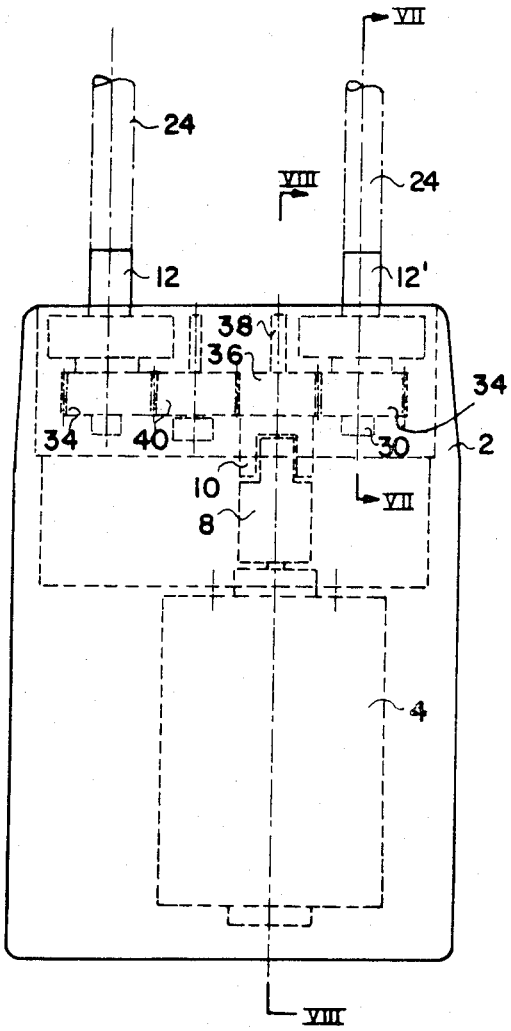
FIG. 6 is an illustration of the mechanical interconnections of an alternative embodiment of the apparatus of the present invention.
Figure 7:
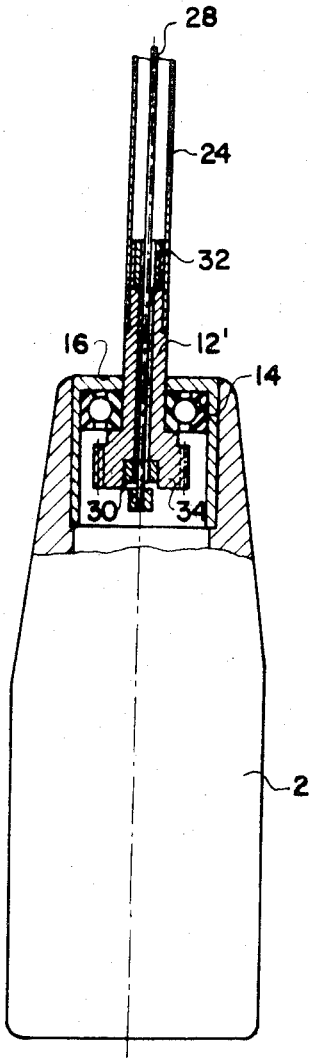
FIG. 7 is a partial side view sectional illustation of the apparatus of FIG. 6 taken in the plane VII—VII illustrated in FIG. 6.
Figure 9:
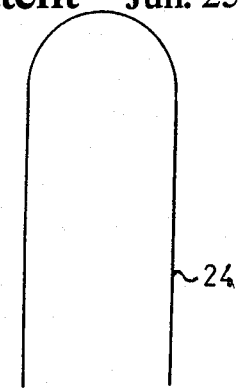
FIGS. 9–14 are simplified schematic illustrations of alternative configurations of the helical spring which may be employed in the apparatus of the present invention.
Figure 10:
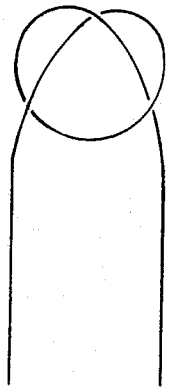
Figure 11:
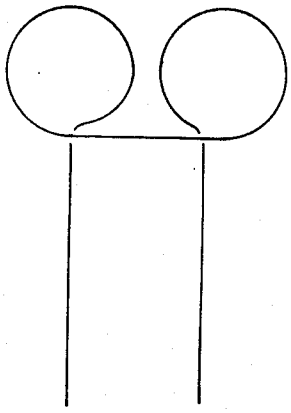
Figure 12:
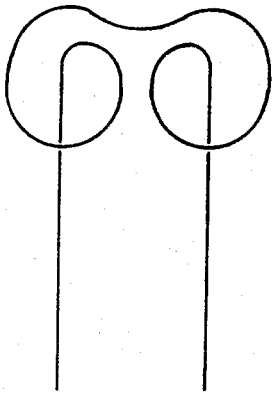
Figure 13:
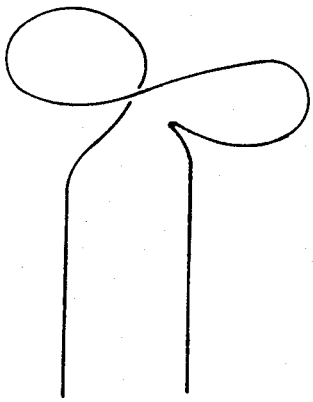
Figure 14:
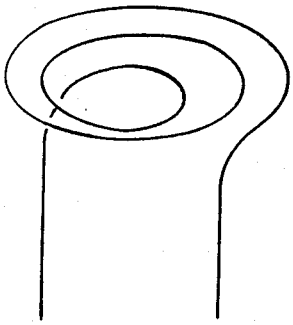

An alternative embodiment of the device constructed and operative in accordance with the present invention is illustrated in FIGS. 6–8. This embodiment employs a single electric motor 4 and employs a gear transmission for driving both spindles 12 and 12'. Each spindle is provided at its lower end with an integral gear 34. The motor 4, via the tongue and groove couple described hereinabove in connection with FIGS. 1–4, drives a gear wheel 36, shown in FIG. 8, mounted on a shaft 38 attached to the bearing mount 16. In this embodiment, the gear 36 is integral with the groove member 10. The other spindle, 12 is driven by the same gear 36, but via an idler gear 40, which also provides the required counter rotation relative to spindle 12'.

In an alternative simplified version of this embodiment, the single motor 4 may be directly connected to one of the two spindles, such as spindle 12. There is no gear train and spindle 12' and its bearing 14 is provided only for rotatable, low resistance, attachment of the non-driven end of spring 24 to the housing.

An another alternative embodiment, a single motor having a pair of output shafts 6 may be employed. In this embodiment, each output shaft may drive one of the ends of the spring 24 in rotational motion.

According to a further alternative embodiment of the invention, stationary motors of the type having a flexible power output shaft and associated chuck for connection to a selectable rotary tool may be employed. In such an embodiment, the apparatus would also comprise a gear train such as 34, 40, 36, 34, the helical spring drivingly attached thereto as well as a connecting spindle for coupling to the chuck of the flexible shaft.

FIGS. 9–14 are self-explanatory, schematically simplified drawings of some additional configurations of the spring arrangement. While the configurations of FIGS. 9–12 are substantially planar, neglecting the thickness of the spring itself, the figure-eight configuration of FIG. 13 and the spiral of FIG. 14 lie in planes substantially perpendicualr to the plane of the "legs" of these configurations.

While in the preferred embodiments show, the motors as described hereinabove, are electric motors which may be battery powered or powered by line current from the mains, embodiments of the invention may alternatively employ pneumatic or hydraulic motors provided with a source of a driving fluid and suitable speed control apparatus.

It will be evident to those skilled in the art that the invention is not limited to the details of the foregoing illustrative embodiments, and that the present invention may be embodied in other specific forms without departing from the essential attributes thereof, and it is therefore desired that the present embodiments be considered in all respects as illustrative and not restrictive, reference being made to the appended claims, rather than to the foregoing description, and all variations which come within the meaning and range of equivalency of the claims are therefore intended to be embraced therein.

We claim:

1. An electrically powered depilatory device comprising:

a hand held portable housing;

motor means disposed in said housing; and a helical spring comprising a plurality of adjacent windings arranged to be driven by said motor means in rotational sliding motion relative to skin bearing hair to be removed, said helical spring including an arcuate hair engaging portion arranged to define a convex side whereat the windings are spread apart, and a concave side corresponding thereto whereat the windings are pressed together, the rotational motion of the helical spring producing continuous motion of the windings from a spread apart orientation at the convex side to a pressed together orientation at the concave side and for engagement and plucking of hair from the skin of the subject, whereby the surface velocities of the windings relative to the skin greatly exceeds the surface velocity of the housing relative thereto.

2. An electrically powered depilatory device according to claim 1 and wherein said helical spring arcuate hair engaging portion extends along an arc subtending more than 90 degrees whereby the surface velocities of windings of the helical spring simultaneously include components extending in mutually perpendicular directions, for significantly enhanced hair removal efficiency.

3. An electrically powered depilatory device according to claim 1 and wherein said helical spring arcuate hair engaging portion extends along an arc subtending more than 180 degrees.

4. An electrically powered depilatory device according to claim 2 and wherein said helical spring arcuate hair engaging portion extends along an arc subtending more than 180 degrees.

5. An electrically powered depilatory device comprising:

a hand held portable housing;

motor means disposed in said housing; and a helical spring comprising a plurality of adjacent windings arranged in a loop for being driven in rotational motion by said motor means, said helical spring loop defining along substantially the entire length thereof an arcuate hair engaging portion arranged to define a convex side whereat the windings are spread apart, and a concave side corresponding thereto whereat the windings are pressed together, the rotational motion of said helical spring producing continuous motion of the windings from a spread apart orientation at the convex side to a pressed together orientation at the concave side and for engagement and plucking of hair from the skin of the subject.

6. An electrically powered depilatory device according to claim 1 and wherein said helical spring is oriented such that at said convex side of said hair engaging portion, the orientation of adjacent spread apart windings defines an angle therebetween of at least 1.5 degrees.

7. An electrically powered depilatory device according to claim 5 and wherein said helical spring is oriented such that at said convex side of said hair engaging portion, the orientation of adjacent spread apart windings defines an angle therebetween of at least 1.5 degrees.

8. An electrically powered depilatory device according to claim 7 and wherein said angle between adjacent spread apart windings is at least 2.0 degrees.

9. An electrically powered depilatory device according to claim 1 and wherein said helical spring is oriented such that at said convex side of said hair engaging portion, the orientation of the adjacent spread apart windings defines a maximum separation of at least 0.15 mm.

10. An electrically powered depilatory device according to claim 1 and wherein said helical spring is oriented such that at said convex side of said hair engaging portion, the orientation of the adjacent spread apart windings defines a maximum separation of at least 0.2 mm.

11. An electrically powered depilatory device according to claim 1 and wherein said housing is defined as a modular two part housing, one part including the motor apparatus and the other part including the helical spring, whereby the part including the helical spring may be readily removed from the part including the motor apparatus for easy sanitization of the helical spring or replacement thereof as desired.

12. An electrically powered depilatory device according to claim 1 and wherein said motor means comprises a pair of motors coupled to respective opposite free ends of the helical spring.

13. An electrically powered depilatory device according to claim 1 and wherein said motor means comprises a single motor.

14. An electrically powered depilatory device according to claim 5 and wherein said helical spring is oriented such that at said convex side of said hair engaging portion, the orientation of the adjacent spread apart windings defines a maximum separation of at least 0.15 mm.

15. An electrically powered depilatory device according to claim 5 and wherein said helical spring is oriented such that at said convex side of said hair engaging portion, the orientation of the adjacent spread apart windings defines a maximum separation of at least 0.2 mm.

16. An electrically powered depilatory device according to claim 5 and wherein said housing is defined as a modular two part housing, one part including the motor apparatus and the other part including the helical spring, whereby the part including the helical spring may be readily removed from the part including the motor apparatus for easy sanitization of the helical spring or replacement thereof as desired.

17. An electrically powered depilatory device according to claim 5 and wherein said motor means comprises a pair of motors coupled to respective opposite free ends of the helical spring.

18. An electrically powered depilatory device according to claim 5 and wherein said motor means comprises a single motor.

19. A powered depilatory device comprising:

a portable housing;

at least one motor accommodated in said housing;

a first and a second spindle rotatably mounted to said housing, of which at least said first spindle is coupled to, and driven by, at least said motor; and a helical spring, one end of which is fixedly attached to said first spindle and thereby rotatable by at least said motor, and the second end of which is fixedly attached to said second spindle, at least one portion of said spring between said two spindles being arcuate and subtending an angle of at least 180 degrees to the effect at that the convex side of said arcuate portion the windings of said helical spring are spread open, while at the concave side of said arcuate portion they are pressed together, whereby wedge-like gaps are formed between adjacent windings along at least a major portion of said arcuate portion.

20. The depilatory device as claimed in claim 19, wherein said motor is an electric motor.

21. The depilatory device as claimed in claim 19 wherein two electric motors are provided, wired for rotation in mutually opposite senses.

22. The depilatory device as claimed in claim 19, wherein one electric motor only is provided and wherein a gear train is used to drive also said second spindle, which gear train comprises an idler gear to reverse the sense of rotation of said second spindle relative to said first spindle.

23. The depilatory device as claimed in claim 19 and further comprising a stiffening wire inside said spring, which wire is substantially stationary relative to said spring.

24. The depilatory device as claimed in claim 1, wherein said rotatably mounted spindles are arranged in a bearing mount removably insertable in said housing.

25. A power drivable depilatory device comprising:

a housing accommodating a first and second spindle rotatably mounted thereto, of which at least said first spindle is coupled to and driven by a source of rotary power; a helical spring, one end of which is fixedly attached to said first spindle and thereby rotatable by said source of rotary power, and the second end of which is fixedly attached to said second spindle, at least one portion of said spring between said two spindles being arcuate and subtending an angle of at least 180 degrees to the effect that at the convex side of its arcuate shape the windings of said helical spring are spread open, while at the concave side of said arcuate shape they are pressed together. whereby wedge-like gaps are formed between adjacent windings along at least a major portion of said arcuate portion.

26. A powered depilatory device according to claim 1, wherein said portion of said spring between said two spindles subtends an angle of at least 360 degrees.

27. A depilatory device according to claim 1 and wherein said helical spring is driven in rotary motion having a surface speed of at least 70 meters per minute.

28. A depilatory device according to claim 5 and wherein said helical spring is driven in rotary motion having a surface speed of at least 70 meters per minute.

29. A depilatory device according to claim 1 and wherein said helical spring is driven in rotary motion having a surface speed above 100 meters per minute.

30. A depilatory device according to claim 5 and wherein said helical spring is driven in rotary motion having a surface speed above 100 meters per minute.

* * * * *